United States Patent [19]

Newton, II

[11] Patent Number: 4,754,584

[45] Date of Patent: Jul. 5, 1988

[54] MODULAR SECURITY CELL

[75] Inventor: William D. Newton, II, Tulsa, Okla.

[73] Assignee: Uniwall Corp., Tulsa, Okla.

[21] Appl. No.: 868,537

[22] Filed: May 29, 1986

[51] Int. Cl.[4] ..... E04H 3/08; E04C 2/38; E04B 1/56; E04B 2/82

[52] U.S. Cl. ..... 52/106; 52/127.5; 52/127.7; 52/127.12; 52/581

[58] Field of Search ..... 52/106, 127.5, 127.6, 52/127.7, 127.12, 581

[56] References Cited

U.S. PATENT DOCUMENTS

| | | | |
|---|---|---|---|
| 956,787 | 5/1910 | Youngblood | 52/106 |
| 2,059,757 | 11/1936 | Sprecker | 52/106 |
| 2,114,387 | 4/1938 | Killion | 52/127.7 |
| 2,192,173 | 3/1940 | Anderson | 52/127.6 |
| 2,766,855 | 10/1956 | Johnson et al. | 52/127.12 |
| 2,825,098 | 3/1958 | Hultquist | 20/2 |
| 2,893,067 | 7/1959 | Meek | 20/4 |
| 3,198,562 | 8/1965 | Smith | 287/58 |
| 3,264,019 | 8/1966 | Houvener et al. | 287/189.35 |
| 3,285,635 | 11/1966 | Whelan | 52/127.12 |
| 3,292,323 | 12/1966 | Hagan | 52/127.12 |
| 3,349,528 | 10/1967 | Salt | 52/127.5 |
| 3,693,308 | 9/1972 | Frezzini et al. | 52/127.5 |
| 3,722,152 | 3/1973 | Schlatter et al. | 52/106 |
| 3,994,105 | 11/1976 | Jamison et al. | 52/127.7 |
| 4,484,831 | 11/1984 | Hanson, Jr. et al. . | |

FOREIGN PATENT DOCUMENTS

| | | | |
|---|---|---|---|
| 872107 | 3/1953 | Fed. Rep. of Germany | 52/127.12 |

*Primary Examiner*—Carl D. Friedman
*Assistant Examiner*—Michael Safavi
*Attorney, Agent, or Firm*—Head & Johnson

[57] ABSTRACT

A security cell is adapted for expedient assembly in existing walled buildings and is primarily constructed of substantially identical wall and ceiling panels that are assembled adjacent existing walls and windows with connectors that are unexposed and inaccessible to the inmate.

28 Claims, 11 Drawing Sheets

MODULAR SECURITY CELL

BACKGROUND

This invention is directed to security or jail cell construction for use in existing or new buildings. More particular, the invention is related to a modular wall and ceiling system manufactured of substantially similar prefabricated units or panels and a method of assembling the units into a cell structure. The structure is for particular use as a speedily erected temporary or permanent prison housing, although the invention could have applicability to other uses where the concepts of the construction would warrant. The problem that this invention overcomes is accomplishing the construction where there is limited space usually adjacent existing walls.

SUMMARY

It is the principal object of the present invention to provide a modular wall and ceiling system to create individual security cells which, because of its particular structural features, is capable of being quickly installed within existing buildings, although it can be used as the external building structure as well as the internal wall and ceiling structure of a new building.

A specific object of the invention is to provide a maximum security cell wherein the wall fastening system is unexposed or inaccessible to the cell interior and not capable of being reached by a person therein.

Another object of the invention is to provide a security or jail cell construction made up of substantially identical prefabricated panels which can be assembled without exposed fasteners to produce finished walls and roof or ceiling in a limited space adjacent existing walls and ceiling. The panels are capable of being standardized to permit volume production.

A yet further object of the invention is to provide a security cell construction for use as a part of a correctional institution that can be rapidly constructed by a method which prevents exposure of the fasteners and inaccessibility of the fasteners to the inmate or other person within the cell.

A yet further object of the invention is to provide a maximum security cell construction that is economical and simple to construct.

The security cell is preferably constructed upon a preset floor or frame from which opposed side walls and a ceiling are constructed by ultimately connecting together at intersecting corners with fastening means that are either unexposed or inaccessible to the cell interior. The walls are comprised of a plurality of panels that are substantially identical in the manner of connecting them together to achieve the overall purpose of the invention. Each of the basic panel units are rectangular in shape with a front planar cell-side surface having an open rear side created by a rearwardly extending transverse frame. The frame is defined by top, bottom, and first and second vertical side members. The first vertical side member has a plurality of vertically spaced connector receiving holes. The second vertical side member has a set of vertically spaced connector attachment holes that are substantially coaxial with the connector receiving holes of the first side. A threaded connector, e.g. weld nut is formed as a part of each connector attachment hole. The second side member also has a plurality of vertically spaced tool access holes adjacent each connector attachment hole. In order to effectively insert and rotate a fastener, e.g. bolt, through each connector receiving hole of the first side of one panel into the treaded connector of the second side of the next adjacent panel, a vertical tool holding line-up strip is provided. The line-up strip is spaced from and parallel to the first side member and includes a plurality of vertically spaced tool guide openings or slots said openings substantially coaxial with said connector receiving holes. The tool access holes and the guide slots provide alignment for a tool used to insert and bolt the panels together especially where there is little or no space from an existing wall. Means are provided at the bottom and top of the panel to attach to the respective floor or floor frame and a ceiling panel. The front of the cell can be a variety of constructions, using either the panels above described, or double walled partitions as a totally closed, maximum security cell or barred panels typical of most jail cell construction. The cell will, of course, include necessary lockable access doors or openings.

Other objects of the invention both as to its construction and method can best be understood from the following description of the preferred embodiments when read in connection with the accompanying drawings.

DESCRIPTION OF THE PREFERRED EMBODIMENTS

Figure 1:
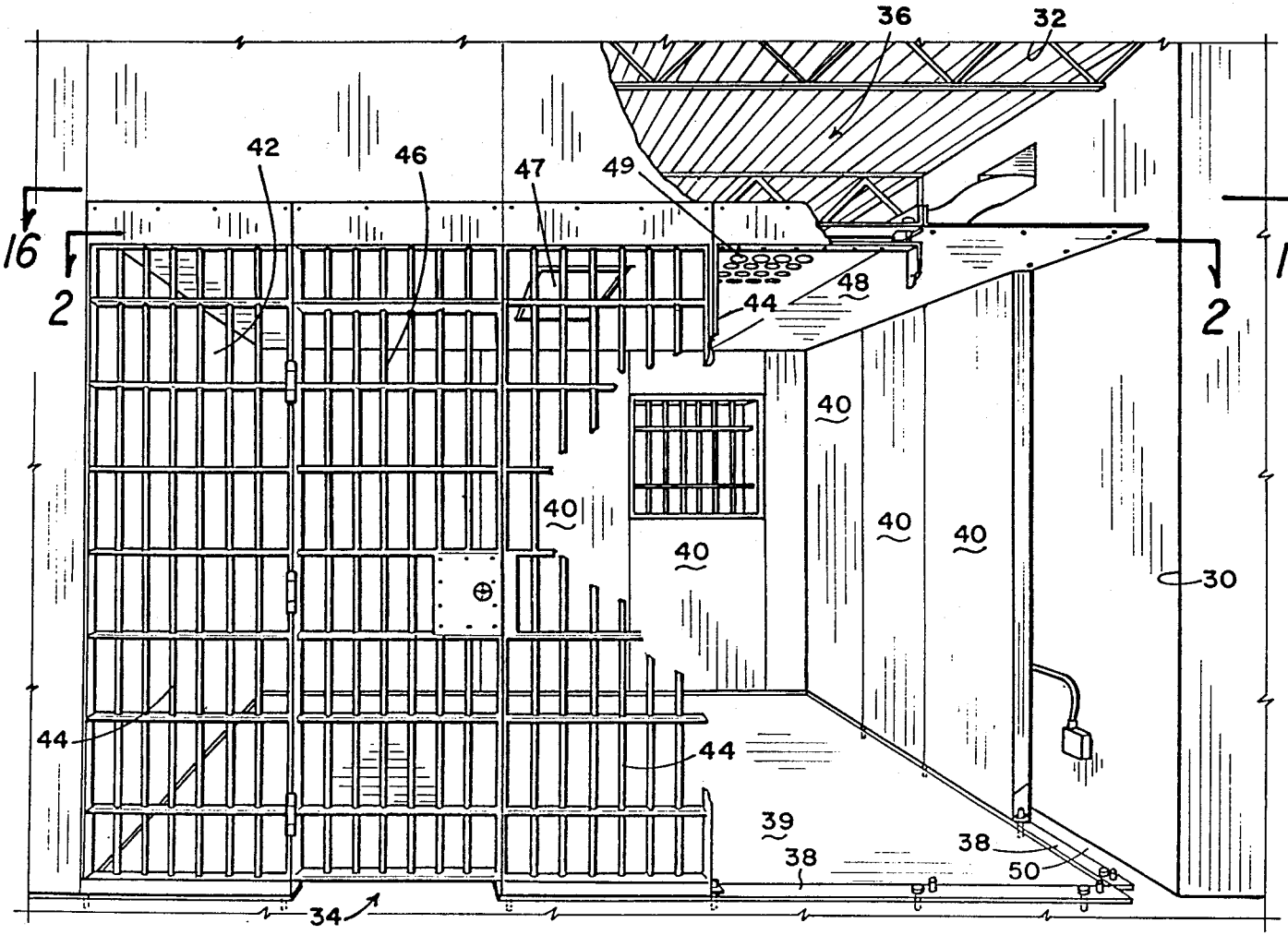
FIG. 1 is a frontal, partly cut away perspective view of a security cell constructed in accordance with the concepts of this invention.

Referring now specifically to FIG. 1 the security cell of this invention is shown constructed in an existing building and/or floor of that building having exterior or interior walls 30 and existing ceiling construction 32. The particular security cell generally designated by the numeral 34 is constructed so as to leave, in this instance, a work space, generally designated as 36, between the top of the security cell and ceiling 32. This space, of course, provides access for the final construction of the security cell in the placement of its ceiling and to further provide access means for utility conduits, heating, air conditioning, lighting, etc. The security cell, in its preferred embodiment is constructed of a base frame 38 to which back and side panels 40 are attached in a manner hereafter described. The base frame is connected to floor 39 with connectors 94 (See FIG. 14). In this embodiment, the left side panels are constructed as a double sided partition member 42 creating an additional cell on the other side thereof. The front of the cell is comprised of a plurality of barred panels 44 including a lockable barred door 46. The ceiling is comprised of a plurality of substantially identical panels 48 which may or may not include suitable and secure inaccessible lighting 47 and/or ventillation 49. As shown in FIG. 1 and in other views, the baseplate 38 and panels 40 are erected in such a manner as to provide minimal spacing 50 between the back side of the panels 40 and the existing building wall 30.

Figure 3:
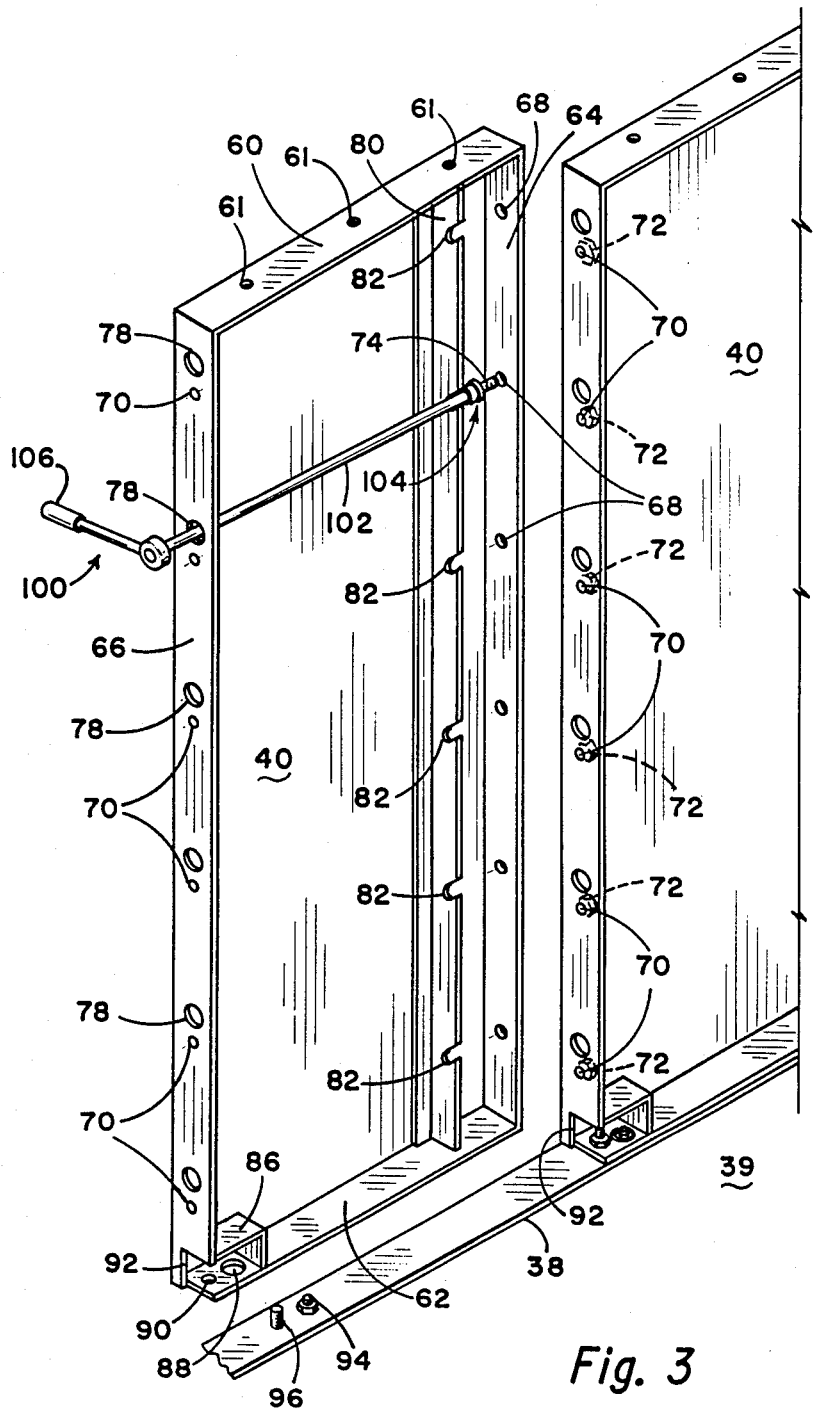
FIG. 3 is a perspective view not only of a typical panel construction used with this invention but also the method of assembly thereof.

Referring now to FIG. 3 the basic prefabricated panel is depicted and shown in relation to the method of assembly. The panel is constructed of its front face 40 which is a planar surface that faces the security cell interior. The rear of the panel as best shown in FIG. 3 is open and defined by a rearwardly extending transverse frame formed by bending and/or welding from or to the back side of planar surface 40. This frame comprises a top member 60, a bottom member 62 connected to a first vertical side member 64 and a second vertical side member 66. The first side member has a plurality of vertically spaced connector receiving openings 68. Second side member 66 has a set of vertically spaced connector attachment holes 70 which are coaxial with said connector receiving holes 68. Contiguous with each of the connector attachment holes 70 is a means, such as a weld nut 72, to receive and connect with a connection means, i.e., bolt 74 to retain adjacent panels 40 together. The connection means 72 could be a variety of interlocking members including a bayonnet type and/or wherein the openings 70 are threaded or self-tapping screws could be used. That is, the means for interconnecting the panels is not limited to that shown and described herein. Second side member 66 further includes a plurality of vertically spaced tool access holes 78 for use as hereinafter described. The panel further includes a vertical line-up strip 80 which is spaced from the first side member a short distance and includes a plurality of vertically spaced tool guide openings or slots 82. A portion of the opening or slot is substantially coaxial with the connector receiving holes 68. The bottom portion of the frame 62 includes a recessed box 86 below which are two openings, one a larger opening 88 and a smaller bolt receiving opening 90. The recess has an opening 92 through the second vertical side 66 in order for the assembler to have access to the connecting mechanism herein described. The opening 92, during the assembly is closed once the first vertical side member 64 is positioned to cover same. Recess opening 88, during construction is adapted to be received over a connection means 94 which is attached to the floor 39. As a part of the base frame 38, previously attached to the floor 39, are a plurality of spaced threaded bolts 96 which are adapted to be received into opening 90 of the recess 86.

Also shown in FIG. 3 is a typical tool generally designated by the numeral 100, for assemblying the panels together. The tool includes a rod 102 which at one end has a means 104 for temporary attachment or connection with bolt 74. The other end includes a means for attachment of a ratchet wrench 106. One form of temporary bolt attachment mechanism, in greater detail, is shown in FIG. 6.

Figure 4:
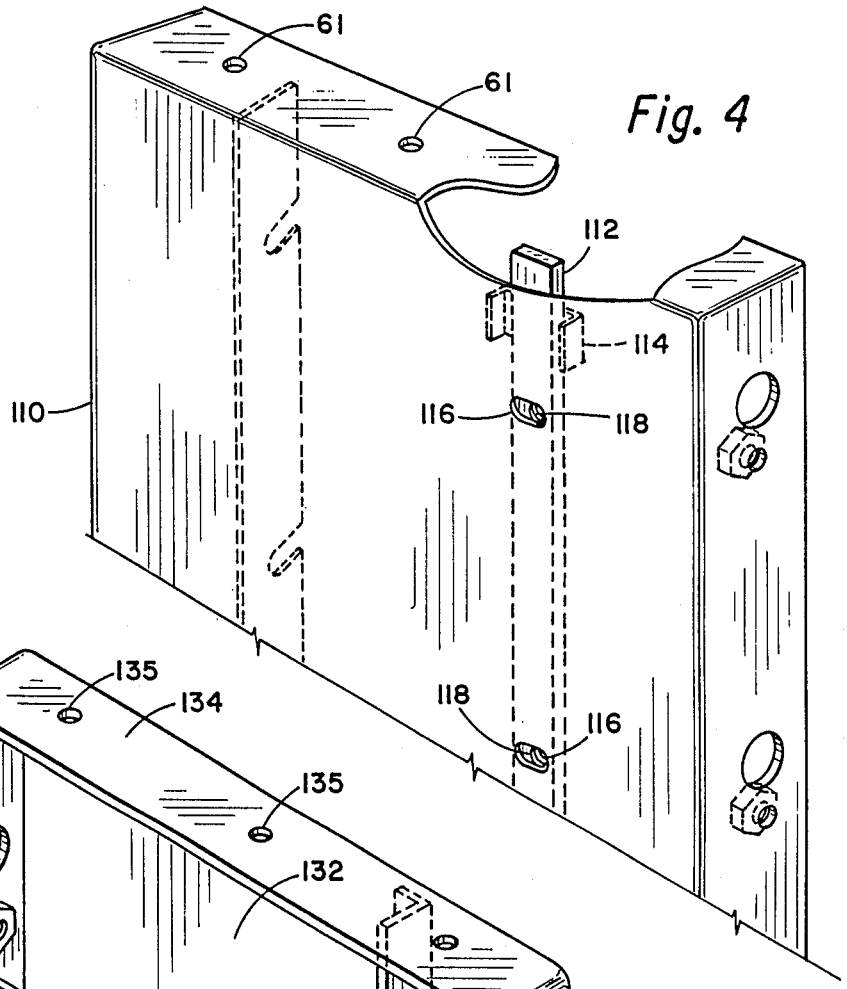
FIG. 4 is a partial sectional view of a modified panel unit that is used at the point of intersection of a wall or partition.

FIG. 4 is representative of a modified panel 110, which is adapted for use (See FIG. 2) where a connecting partition type of wall 42 will intersect and connect to the existing back wall. In all respects, the panel 110 will be identical to the panels 40 heretofore described in FIG. 3, including, however, a vertically disposed attachment plate 112 which is vertically suspended for horizontal movement within a plurality of brackets 114 shown by dotted lines. At the point of intersection of the partition wall 42, in this embodiment, are a plurality of vertically spaced slotted openings 116. Opposite each slot a threaded opening 118 is provided in the attachment plate 112 for interconnection with the partition wall 42. These openings will generally coincide with the vertically spaced connector receiving openings found on the first vertical side of the next adjacent connecting panel. Such a partition panel 42 is shown partially in FIG. 5 and the opening noted above is identified by the numeral 126. The panel 42 includes both a front and rear planar panels 130 and 132 spaced apart by a transverse frame having a top 134 and ceiling attachment holes 135 and a bottom, not shown, all of which are connected to a first vertical side wall 136 and a second vertical side wall 138 to form the rectangular space therein. A tool access hole 140 is provided in this second vertical side wall and also a threaded opening 142 adjacent thereto. The threaded opening 142 may be a weld nut as previously described or other types of interconnection means. Similar to panels 40, a vertical line-up strip 144 is provided adjacent the first vertical side 136 and includes therewith a plurality of vertically spaced tool guide openings or slots 146 as previously described. It is well to note that in this embodiment and in the panel shown in FIGS. 3 AND 4, the vertical line-up strip does not extend across the transverse width of the frame formed by elements 134, 136 and 138 and thereby leaving a space between the line-up strip 144 and the front planar panel surface 130.

Figure 5:
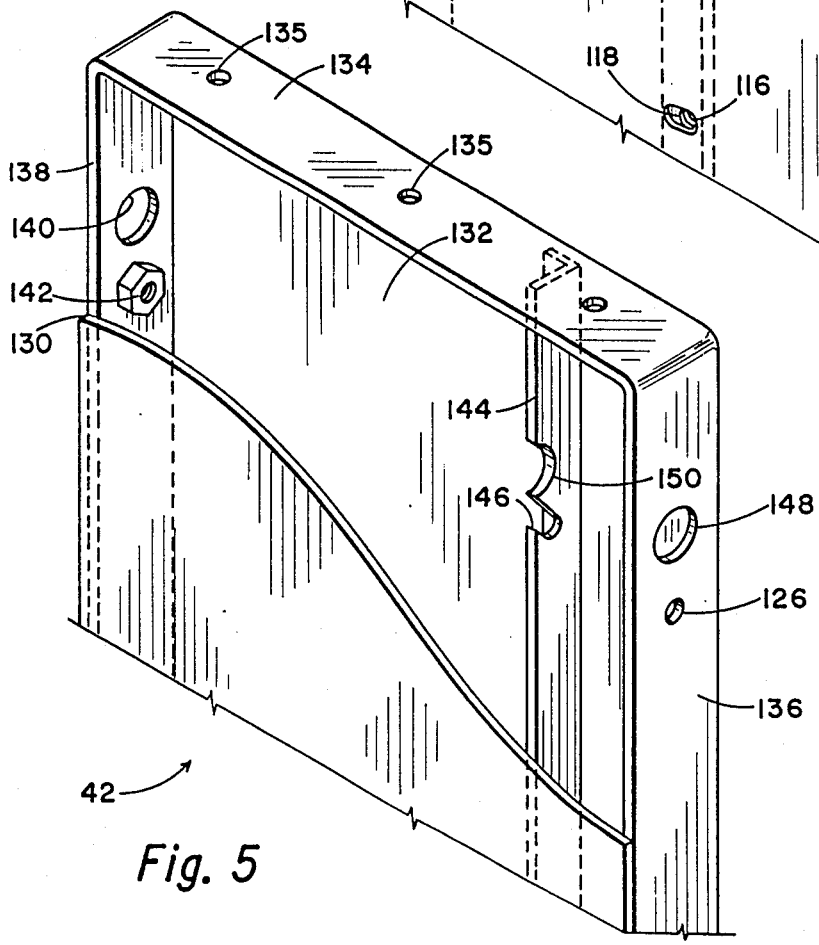
FIG. 5 is a partial sectional view of a double sided partition panel used with this invention.

The embodiment of FIG. 5 shows an alternate embodiment wherein the panel includes along its first vertical side an opening 148 and coaxial opening 150 in the vertical line-up strip 144. This embodiment is also inclusive of the opened back style of panel shown in FIGS. 3 and 4 and is for the purposes of permitting a coaxial aligned opening for the insertion of utility lines, pipes, etc. during the construction.

Figure 6:
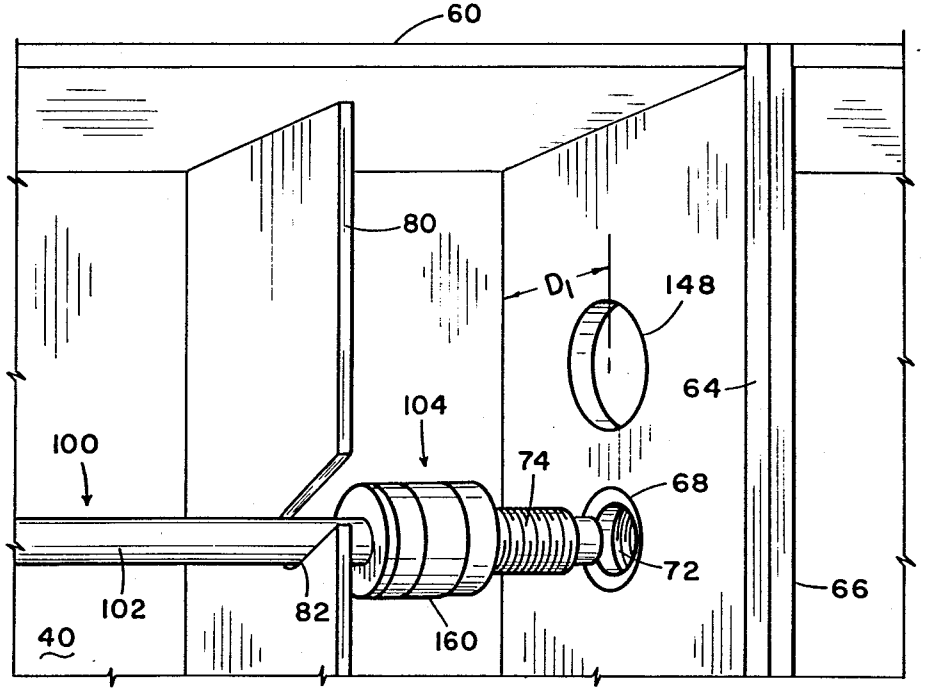
FIG. 6 is an enlarged view of a portion of the wall panel of FIG. 3 in combination with the connecting tool.
Figure 7:
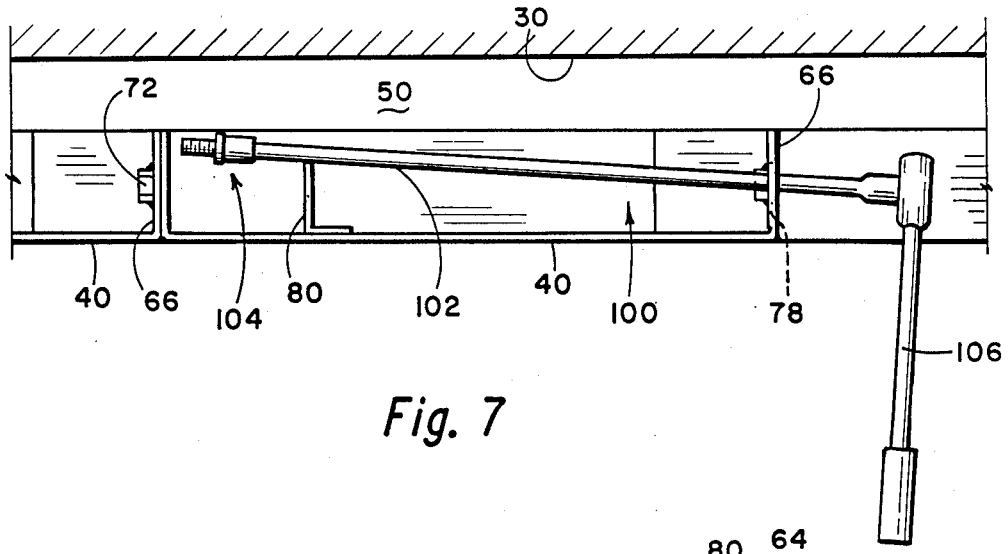
FIGS. 7, 8, 9, 10 and 11 depict various aspects in the assembly of the wall panels of this invention.
Figure 8:
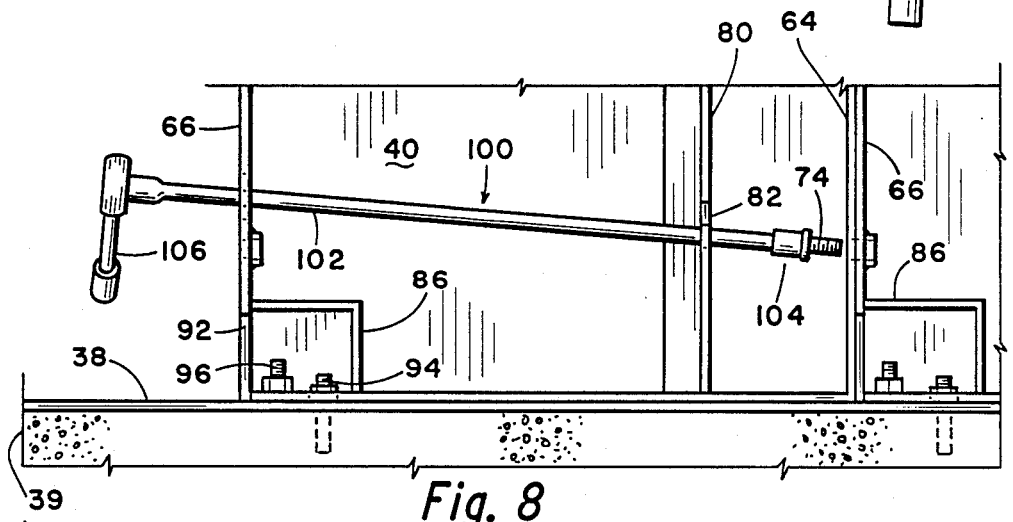

FIG. 6 is an enlarged partial view indicating in larger detail the manner of use of the connecting tool 100 and the bolt interconnection portion generally designated by the numeral 100 and the bolt connection portion generally designed by the numeral 104. In this instance, bolt 74, is retained to the tool by a form of magnetic socket member 160, the purpose being to retain the bolt sufficiently to insert the tool rod 102 into the blind openings and thence into slot 82 to permit alignment and threaded operation through connector receiving openings 68 into connection with the threaded connector attachment means 72. FIGS. 7 and 8, with further reference to FIG. 3 provides details in the manner of connecting the open back panels 40 of the invention with unexposed connectors. The tool rod 102 and bolt holding means 104 will have the bolt 74 connected thereto. A ratchet wrench 106 is connected at the other end. The rod and the attached bolt are then inserted through opening 78 to a position shown by the dotted line, then rotated so that the rod will then rest within the slot 82 of the line-up strip 80, as shown in the solid line position. The tool is then moved, in this instance, to the left in FIG. 7 so that the bolt will pass through connector opening 68 into the threaded connector 72 and thence rotated using the ratchet wrench into its bolted and locked position. The tool is then removed in the reverse manner. This procedure continues from the top to the bottom of the panel or vice-versa with the lowermost connection occuring in the manner shown in FIG. 8. The same procedure is followed as described in FIG. 7.

Figure 11:
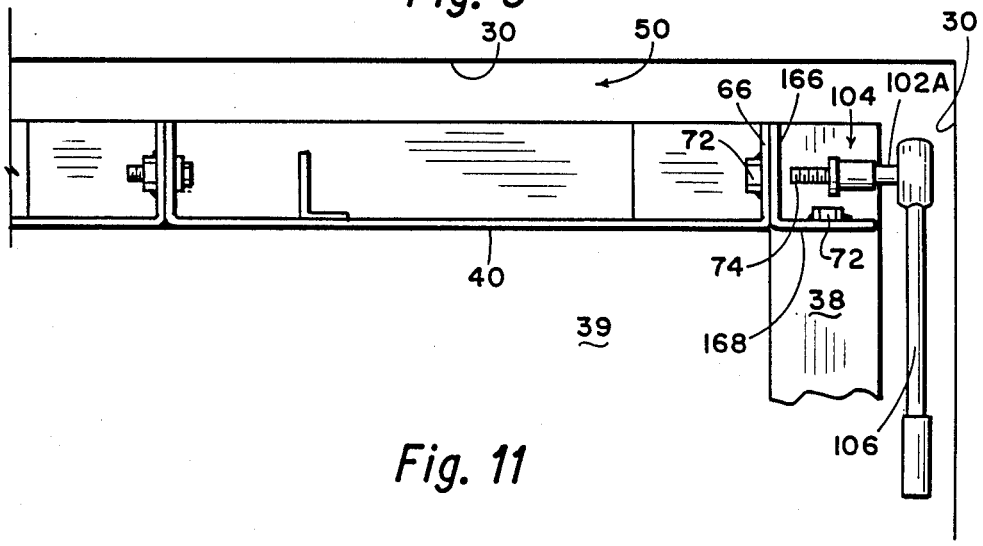
Figure 10:
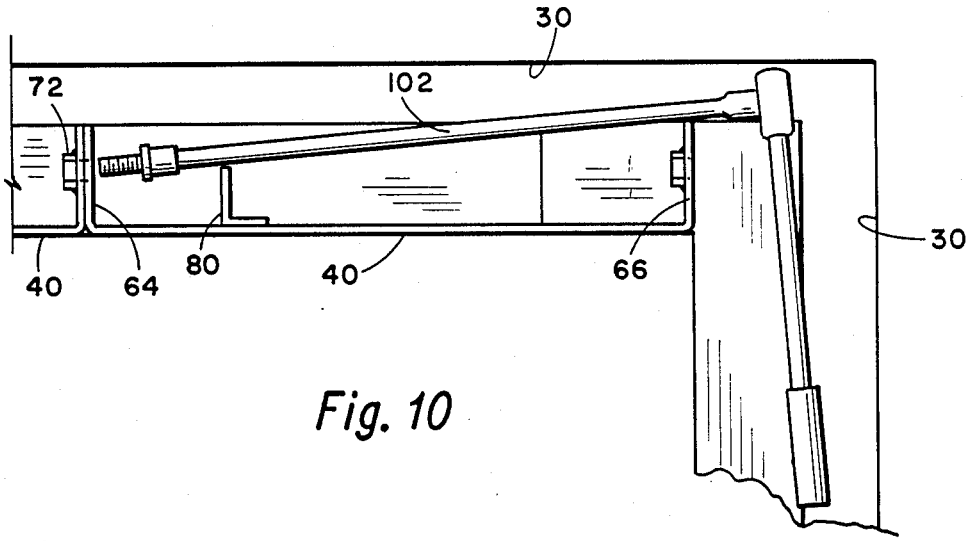
Figure 9:
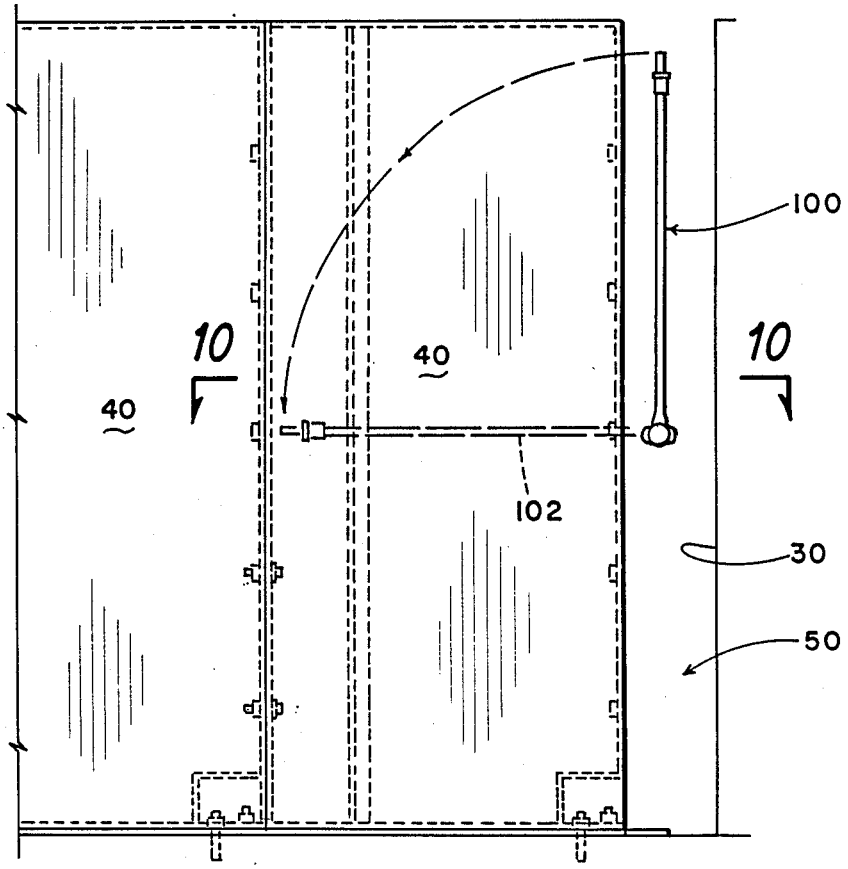

FIGS. 9 and 10 are presented herewith to depict the manner in which the last panel 40 nearing a corner of the existing walls 30 is attached within the limited space 50. As shown in FIG. 9 the tool 100 would be vertically oriented into the space 50 until it passes the back side of the vertical side frame 66 and would then be rotated as shown by the dotted arrow line into the position shown in FIG. 9 and thence fastened in accordance with the procedures heretofore described, except that the wrench rod 102 does not pass through the tool access opening 78. Instead it will go around the back edge of the vertical side member 66 as shown in FIG. 10. From thence the alignment and connection is made as previously described. Once the end panel 40 has been positioned as shown in FIGS. 9 and 10, an end cap plate 166 is attached as shown in FIG. 11 using the ratchet 106 a shortened rod 102A and a connector 104 generally designated using bolt 74 for attachment with the weld nut 72 of the vertical side member 66. The angular plate includes a transverse arm 168 which includes a similar number of spaced vertical attachment members 72 ready to receive and attach the next adjacent panel 40 as previously described.

Once the back and side walls of the security cell have been constructed, the next attachment will be U-shaped end cap 190 (see FIG. 2) wherein the space 50 will be closed off adjacent the existing wall 30. A similar U-shaped cap, but smaller, is utilized to close off the partition wall 42 and is generally designated herein by the numeral 192. Each of these caps are attached to the last adjacent panel 40 by connectors 74 with each of the U-shaped panels then being closed at the front by panel 196 which is held thereto by tamper proof screws 198.

Figure 12:
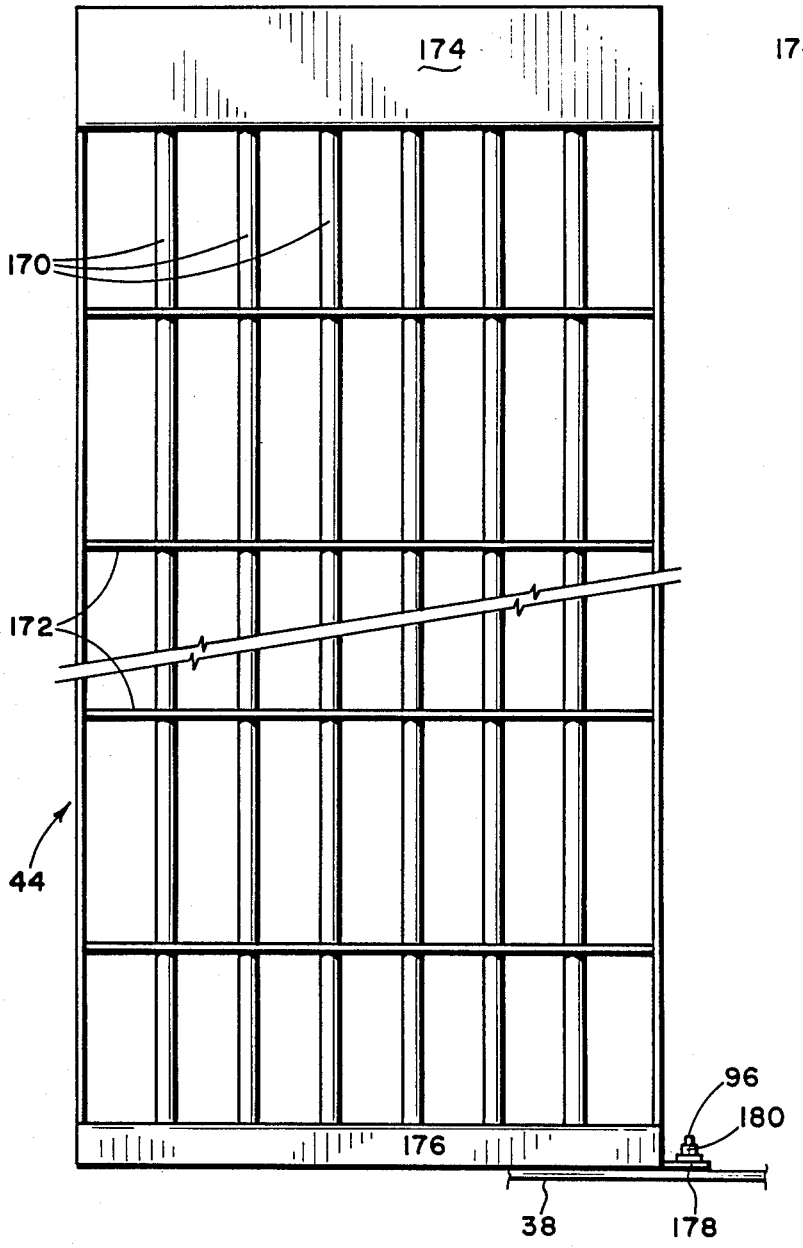
FIG. 12 is a frontal view of a barred panel for use in constructing the security cell of this invention.
Figure 13:
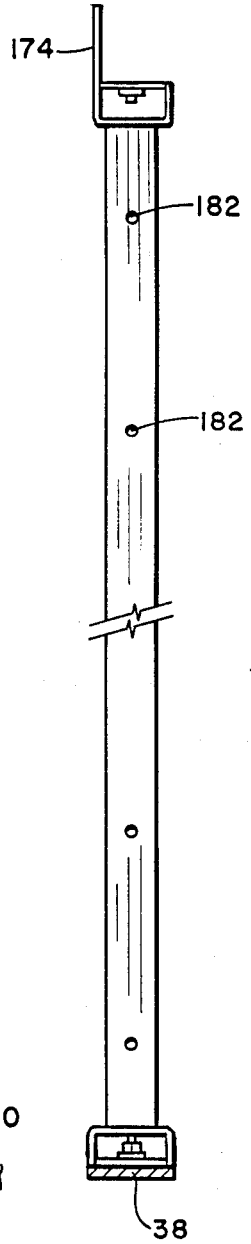
FIG. 13 is a side elevational view of the barred panel of FIG. 12.
Figure 14:
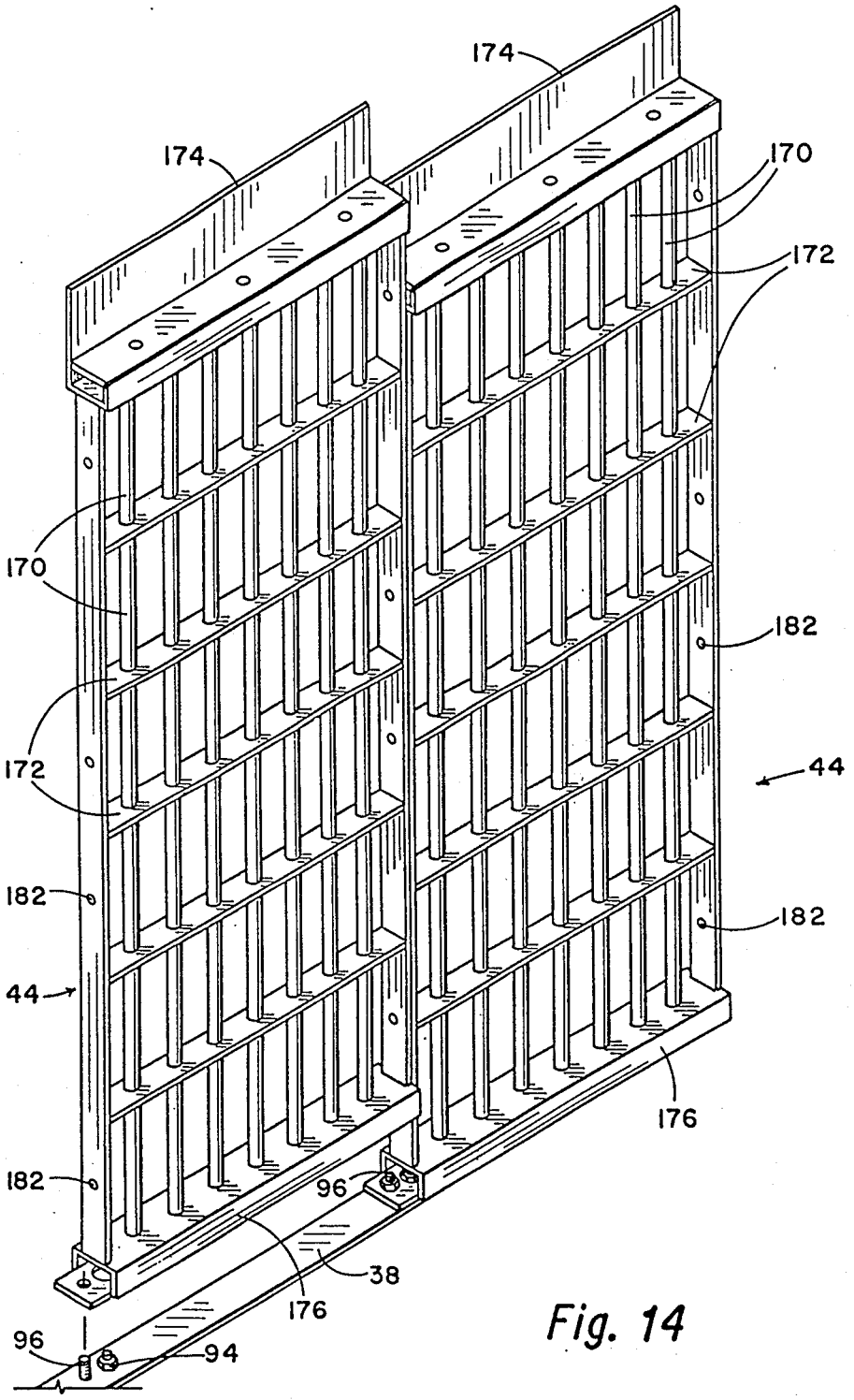
FIG. 14 is a perspective view describing the barred panels and their method of assembly and connection to create the security cell.

FIGS. 12 and 13 depict front and end views of a typical barred panel 44 for use at the front of the security cell. In a typical cell construction, this panel comprises a plurality of vertical members 170 and horizontal connected members 172 connected to a top cap plate 174 and a bottom cap plate 176. An extension 178 of the bottom cap plate 176 is provided to provide a means 180 to attach to and connect with the threaded studs 96 extending from the baseplate 38. Extending along each side of the barred panel 44 are a plurality of vertically spaced openings 182 for providing a means to interconnect the panels with tamper proof connectors such as the type sold under the trademark "Break-Away" sold by Security Fastener Co. The manner of interconnecting the barred panel 44 is shown in FIG. 14. As shown, once the first panel is bolted into place, the next adjacent panel is positioned thereto wherein the bottom enclosure 176 will cover the next adjacent connecting stud and nut 96, etc. Although the barred openings are ordinarily an important part of the security cell, the invention is not limited to the embodiments shown herein as a variety of frontal designs can be adapted from that known in the prior art. This includes the use of hinged and lockable door 46 as is shown in FIG. 1 and/or sliding barred door combinations and/or the continuation of solid panels 40 or partitions 42 with a single opening into the cell.

Figure 15:
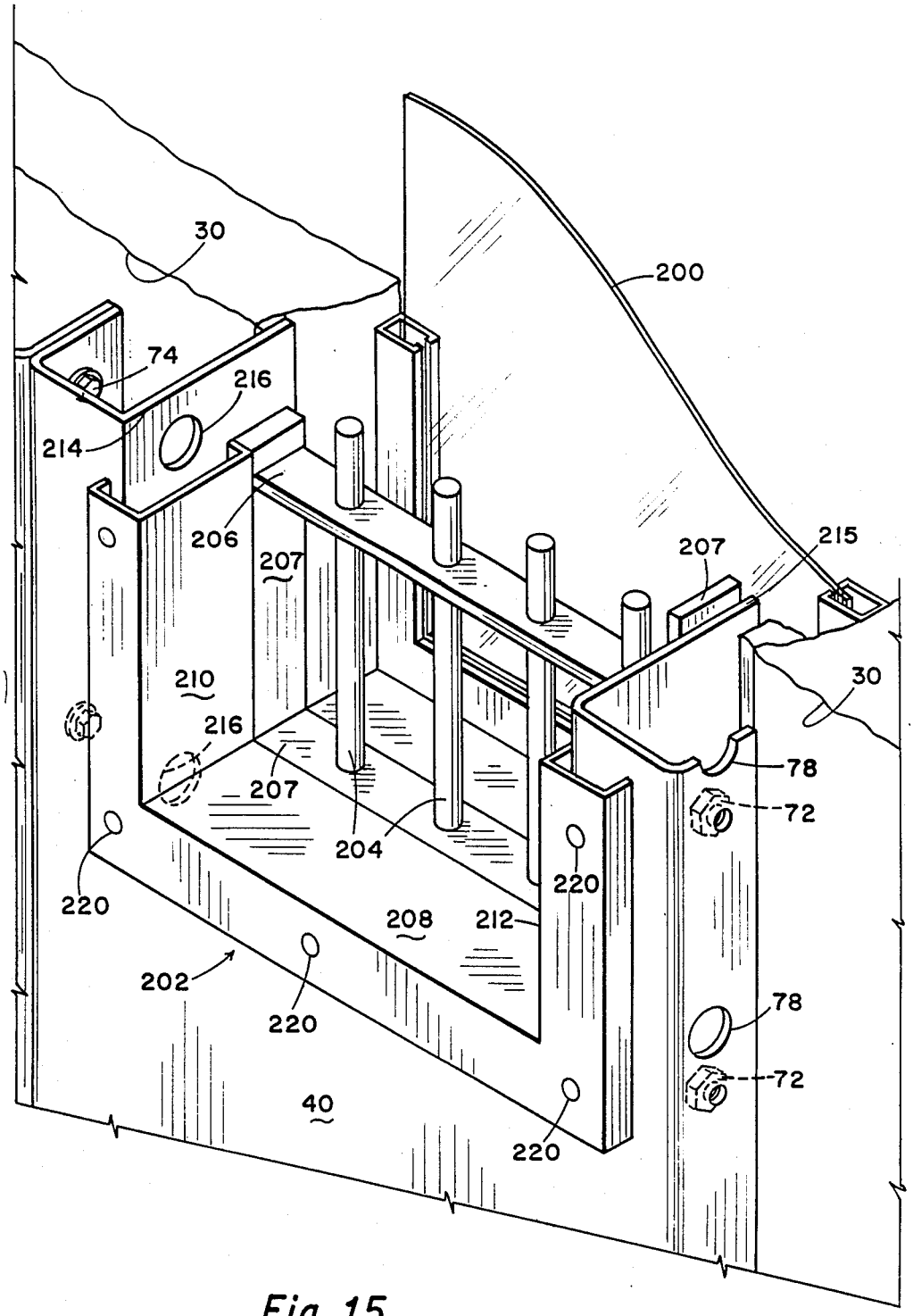
FIG. 15 is a partial sectional view depicting a typical window construction for use in conjunction with the panels of this invention.

In some instances, it may be desirable to provide a window within a panel 40 which may be opposite an existing window in the original building wall. This is shown in FIG. 15 as window 200 which is located within the existing walls 30. In that instance, a prefabricated window opening is formed as a part of panel 40. The opening is formed of adaptor frame members 214 and 215 having therein tool access openings 216 to assemble the panel to the next adjacent panel as heretofore described, i.e., give access to connectors 74. Adaptor frame members 214 and 215 extend rearwardly to fill space 50 and prevent access thereto. Vertical and horizontal bars 204 and 206, respectively, are formed as a part of and permanently affixed to frame 207. A covering frame 202 is then attached to the adaptor frame to cover the access holes 216 using tamperproof connectors 220.

Figure 17:
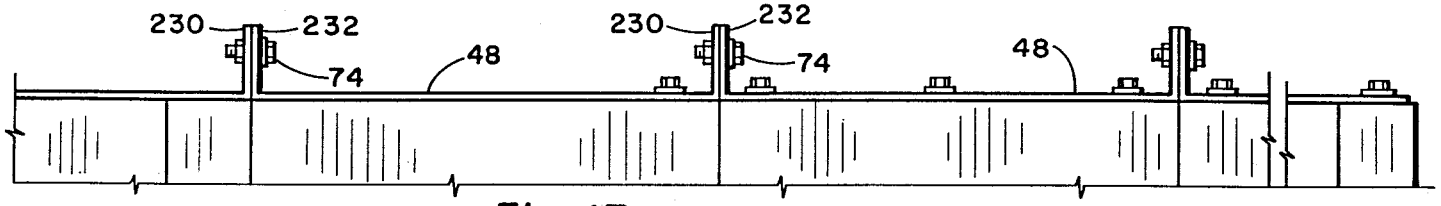
FIG. 17 is a sectional view taken along lines 17—17 of FIG. 16.
Figure 16:
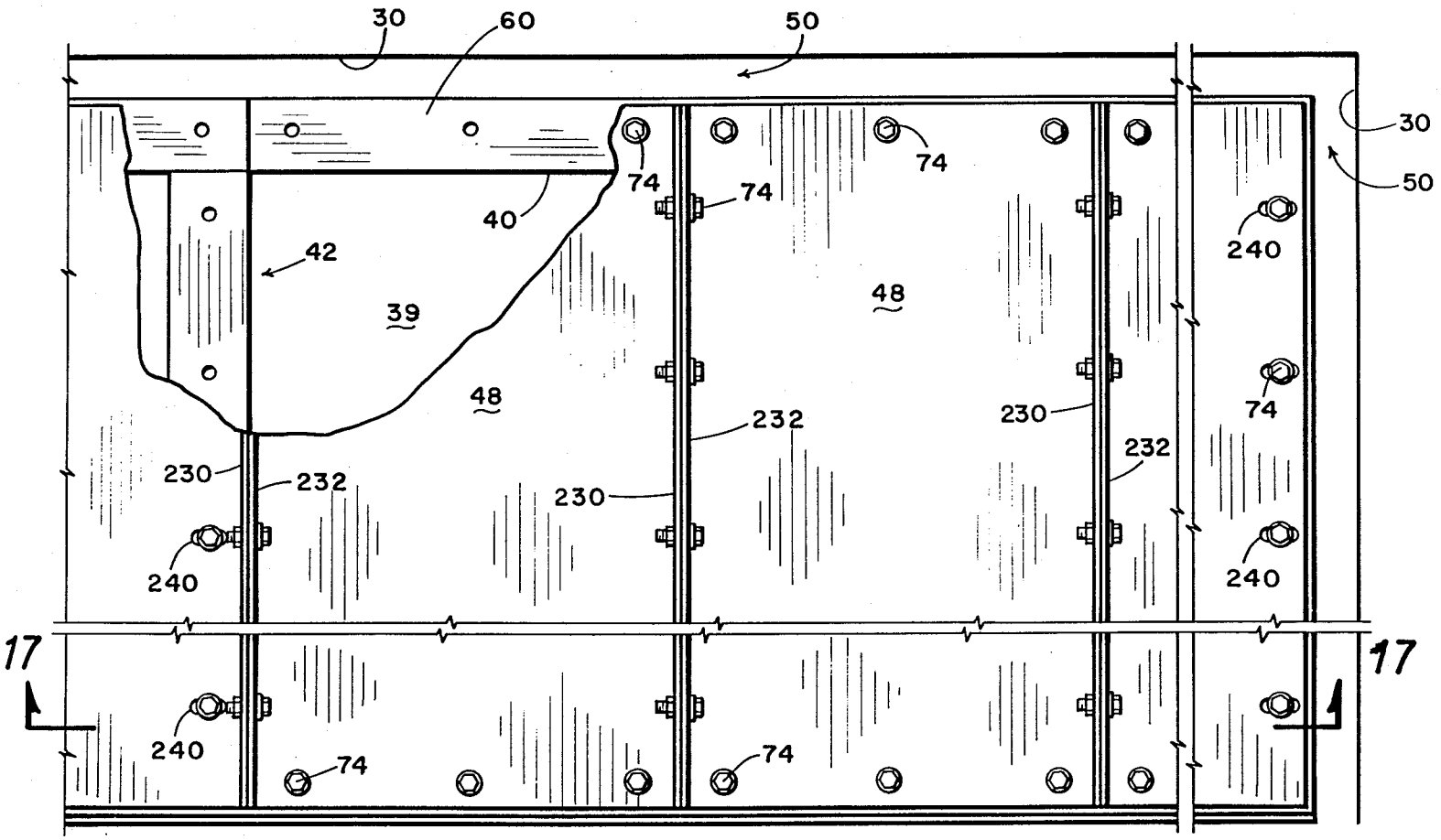
FIG. 16 is a top view of a ceiling construction for the security cell of this invention, partly cut away.

Once the basic back, sides and front have been assembled, the ceiling is then placed in position using, for example, a plurality of panels 48 as shown in FIGURES 16 and 17 which are placed upon the top frames 60 and bolted as shown therein using standard bolting techniques that would be inaccessible to the interior of the cell. Each of the panels is comprised of right and left transverse legs 230 and 232 which are bolted together with connectors 74 which, in this embodiment, is accomplished in the crawl space 36 as shown in FIG. 1. Where the connection is made as for example to an existing partition 42, in some instances a slotted opening 240 is provided to leave means for adjustment and interconnection with the panel.

Figure 2:
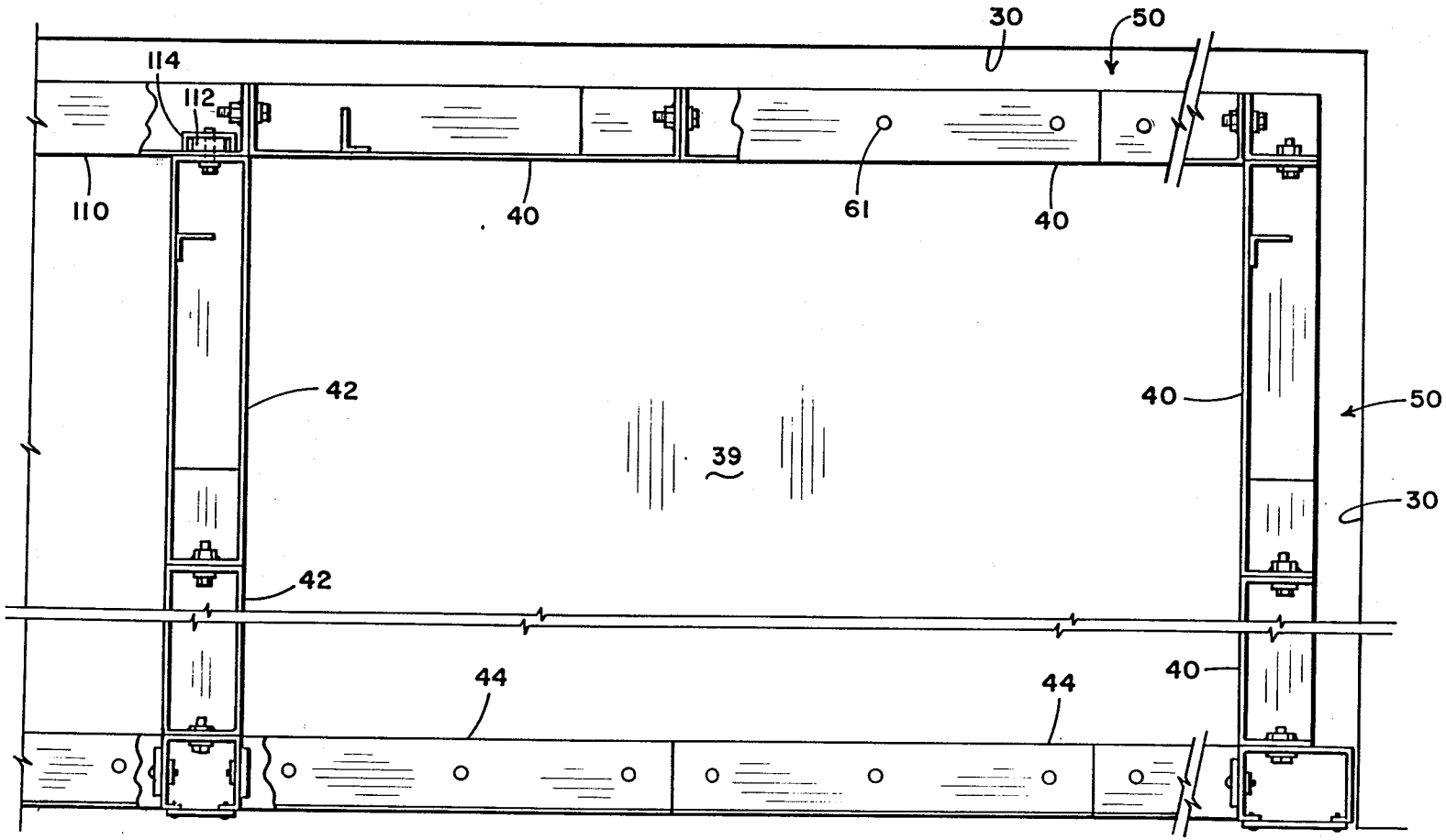
FIG. 2 is a sectional view taken along the line 2—2 of FIG. 1.

The construction of a typical security cell will of course require some design critera, especially where the cells are to be located in existing walled rooms or buildings. The first step thereafter is to lay out the frame 38 and attach same to the floor 39. With reference to FIGS. 1 and 2, the rearward set of panels 40 would begin to the extreme left with assembly to the right, using the technique described with reference to FIGURE 3. At the place where a partition 42 is to be attached, a panel of the FIG. 4 design would be positioned and one partition attached thereto (FIG. 5) by using tool 100 with a bolt 74 through opening 140, thence alignment in slot 146, through hole 126 into the connector opening or slot 116 for attachment to threads 118 of attachment plate 112. The continued assembly of back wall panels 40 continues as described with reference to FIGS. 6 through 11. Once the construction is complete up to the front of the cell, the construction of the barred front and ceiling will enclose the cell. Thence the ceiling shall be placed and the construction completed. The method of construction, of course, can take a variety of steps. for example, if panels 40 are used for the ceiling, i.e., where there is no crawl space 36, the construction may include the simultaneous assembly of the ceiling along with the panels. Such procedures will become readily apparent to the man skilled in the art.

It is to be understood that insulation materials can be readily inserted as a part of panels 40 or 42 as needed.

What is claimed is:

1. Apparatus to construct a security cell for a person, upon an existing floor adjacent at least first and second intersecting walls, comprising a plurality of substantially identical prefabricated wall panels that are slightly spaced from and parallel to said first and second walls to create at least corresponding first side and second back side of said cell, said panels joined together as a unit with connector means that are unexposed to an interior of said cell; each said panel rectangular in shape with a front planar cell side surface and an open rear side created by a rearwardly extending transverse frame, said frame defining top and bottom members and first and second vertical side members, said first side member having a plurality of vertically spaced connector receiving holes, said second side member having a set of vertically spaced connector attachment holes coaxial with said connector receiving holes, means contiguous with said connector attachment holes to connect with said connector means, said second side member having a plurality of vertically spaced tool access holes, a vertical line-up strip spaced from and parallel to said first side member, a plurality of vertically spaced tool guide openings, said openings substantially coaxial with said connector receiving holes; means at the bottom of each said panel to attach said panel to said floor, connector means, at the intersection of said panels, that are unexposed to the interior of said cell; means to connect an intersecting third side wall to said second back side with connector means that are unexposed to the interior of said cell; means to connect a fourth frontal wall of said cell to said floor and to said first and third side walls, with inaccessible connectors, said fourth frontal wall having lockable access means to the interior of said cell; means at the top of each said first side wall, said second back side wall, said third side wall, and said fourth frontal wall to connect with a ceiling using connector means unexposed to said interior of said cell.

2. Apparatus of claim 1 wherein said intersecting third side wall comprises a plurality of panels identical to said prefabricated wall panels.

3. Apparatus according to claim 2 wherein a rear planar surface is attached to the rearwardly extending transverse frame side of each of said prefabricated panels for said third side wall to cover the rear side created by said extending frame.

4. Apparatus according to claim 1 wherein the space between said existing walls and said prefabricated panels is substantially inaccessible to said person.

5. Apparatus according to claim 1 wherein said cell is constructed upon a frame that is attached to said floor.

6. Apparatus according to claims 1, 2, 3, 4 or 5 including a rectangular window opening in one of said prefabricated panels, and means to connect a barred window frame to said opening with connectors that are inaccessible to said person in interior of said cell.

7. Apparatus according to claim 3 wherein said planar surface of said rear side of said third side wall forms a wall for another cell.

8. Apparatus according to claims 1, 2, 3, 4 or 5 wherein said fourth frontal wall is comprised of at least a plurality of identical panels, each said panel comprised of intersecting bars having a top and a bottom U-shaped enclosure, a member extending outward at one side of one side of said panel at the bottom thereof to receive means to attach to said floor, means at an opposite side of said panel at the bottom to enclose said member when connecting said identical panels together, and connector means to connect said panels together whereby said connector means are inaccessible to the person in the interior of said cell.

9. A wall panel for construction contiguous to an existing floor and wall, said panel rectangular in shape with a front planar cell side surface and an open rear side created by a rearwardly extending transverse frame, said frame defining top and bottom members and first and second vertical side members, said first side member having a plurality of vertically spaced connector receiving holes, said second side member having a set of vertically spaced connector attachment holes coaxial with said connector receiving holes, means contiguous with said connector attachment holes to connect with a connector means, said second side member having a plurality of vertically spaced tool access holes, a vertical line-up strip spaced from and parallel to said first side member, a plurality of vertically spaced tool guide openings, said openings substantially coaxial with said connector receiving holes, and means at the bottom member to connect with said floor.

10. A wall panel according to claim 9 wherein said means at the bottom includes a recessed opening from said second side member to connect with said floor.

11. A wall panel according to claims 9 or 10 wherein a rear planar surface is attached to the rearward extensions of said frame.

12. A panel according to claims 9 or 10 wherein each of said connector attachment holes includes a threaded weld nut.

13. A panel according to claims 9 or 10 wherein each of said connector attachment holes is threaded.

14. A panel according to claims 9 or 10 wherein said connector means is a self-tapping screw.

15. Apparatus to construct a security cell for a person, upon an existing floor adjacent at least first and second intersecting walls, comprising a plurality of substantially identical prefabricated wall panels that are slightly spaced from and parallel to said first and second walls to create at least corresponding first side and second back side of said cell, said panels joined together as a unit with connector means that are unexposed to an interior of said cell;

each said panel rectangular in shape with a front planar cell side surface and an open rear side created by a rearwardly extending transverse frame, said frame defining top and bottom members and first and second vertical side members, said first side member having a plurality of vertically spaced connector receiving holes, said second side member having a set of vertically spaced connector attachment holes coaxial with said connector receiving holes, means contiguous with said connector attachment holes to connect with said connector means, said second side member having a plurality of vertically spaced tool access holes, a vertical line-up strip spaced from and parallel to said first side member, a plurality of vertically spaced tool guide openings, said openings substantially coaxial with said connector receiving holes;

means at the bottom of each said panel to attach said panel to said floor, connection means, at the intersection of said panels, that are unexposed to the interior of said cell;

means to connect an intersecting third side to said second back side with connection means that are unexposed to the interior of said cell comprising a plurality of horizontal connector receiving slots in said planar surface which are vertically spaced identical in distance to said connector receiving holes, a vertical bar located on said rearward side that is horizontally movable, said bar including connector attachment means opposite each said receiving slot;

means to connect a fourth frontal wall of said cell to said floor and to said first and third sides, with inaccessible connectors, said fourth frontal wall having lockable access means to the interior of said cell;

means at the top of each said first side, said second back side, said third side, and said fourth frontal wall to connect with a ceiling using connector means unexposed to said interior of said cell.

16. Apparatus of claim 15 wherein said intersecting third side wall comprises a plurality of panels identical to said prefabricated wall panels.

17. Apparatus according to claim 15 wherein a rear planar surface is attached to the rearwardly extending transverse frame of each of said prefabricated panels for said third side wall to cover the rear side created by said extending frame.

18. Apparatus according to claim 17 wherein said planar surface of said rear side of said third side wall forms a wall for another cell.

19. Apparatus according to claim 15 wherein the space between said existing walls and said prefabricated panels is substantially inaccessible to said person.

20. Apparatus according to claim 15 wherein said cell is constructed upon a frame that is attached to said floor.

21. Apparatus according to claims 15, 16, 17, 18, 19 or 20 including a rectangular window opening in one of said prefabricated panels, and means to connect a barred window frame to said opening with connectors that are inaccessible to said person in the interior of said cell.

22. Apparatus according to claims 15, 16, 17, 18, 19 or 20 wherein said fourth frontal wall is comprised of at least a plurality of identical panels, each said panel comprised of intersecting bars having a top and a bottom U-shaped enclosures, a member extending outward at one side of one side of said panel at the bottom thereof to receive means to attach to said floor or floor frame, means at an opposite side of said panel at the bottom to enclose said member when connecting said identical panels together, and connector means to connect said panels together whereby said connector means are inaccessible to the person in the interior of said cell.

23. A wall panel for construction contiguous to an existing floor and wall, said panel rectangular in shape with a front planar cell side surface and an open rear side created by a rearwardly extending transverse frame, said frame defining top and bottom members and first and second vertical side members, said first side member having a plurality of vertically spaced connector receiving holes, said second side member having a set of vertically spaced connector attachment holes coaxial with said connector receiving holes, means contiguous with said connector attachment holes to connect with a connector means, said second side member having a plurality of vertically spaced tool access holes.

a vertical line-up strip spaced from and parallel to said first side member, a plurality of vertically spaced tool guide openings, said openings substantially coaxial with said connector receiving holes, means at the bottom member to connect with said floor; and a plurality of horizontal connector receiving slots which are vertically spaced a distance equal to the spacing of said connector receiving holes, a vertical bar located on said rearward side of said planar cell side surface that is horizontally movable, said bar including connector attachment means opposite each said receiving slot.

24. A wall panel according to claim 23 wherein said means at the bottom includes a recessed opening from said second side member to connect with said floor.

Add the following claims:

25. A panel according to claim 24 wherein said connector attachment means is a weld nut.

26. A panel according to claim 23 wherein said connector attachment means is a threaded opening.

27. A panel according to claim 23 wherein said connector means is a self-tapping screw.

28. A wall panel according to claim 23 wherein a rear planar surface is attached to the rearward extensions of said frame.

* * * * *